US010227794B1

(12) United States Patent
Martin, Jr.

(10) Patent No.: US 10,227,794 B1
(45) Date of Patent: Mar. 12, 2019

(54) SAFE AND SECURE DOOR PLATE

(71) Applicant: Paul T. Martin, Jr., Oneida, NY (US)

(72) Inventor: Paul T. Martin, Jr., Oneida, NY (US)

( * ) Notice: Subject to any disclaimer, the term of this patent is extended or adjusted under 35 U.S.C. 154(b) by 227 days.

(21) Appl. No.: 15/425,910

(22) Filed: Feb. 6, 2017

(51) Int. Cl.

| | |
|---|---|
| ***E05B 15/02*** | (2006.01) |
| ***E05C 1/08*** | (2006.01) |
| ***E05C 19/02*** | (2006.01) |
| ***E05C 21/00*** | (2006.01) |

(52) U.S. Cl.
CPC ..... *E05B 15/0205* (2013.01); *E05C 1/08* (2013.01); *E05C 19/028* (2013.01); *E05C 21/00* (2013.01)

(58) Field of Classification Search
CPC .. E04B 15/02; E04B 15/0205; E04B 17/2003; E04B 17/2084; E05C 1/08; E05C 19/028; E05C 21/00
USPC ..... 292/289, 340, 341, 346; 49/460, 462, 49/504; 52/126.1, 126.2, 126.3, 204.1, 52/213, 215, 514, 656.2, 656.4
See application file for complete search history.

(56) References Cited

U.S. PATENT DOCUMENTS

| | | | | |
|---|---|---|---|---|
| D34,243 | S | 3/1901 | Taylor | |
| 3,130,455 | A * | 4/1964 | Borlenghi | E06B 1/32 49/504 |
| 3,764,173 | A * | 10/1973 | Griffith | E05B 17/2084 292/346 |
| 3,815,945 | A | 6/1974 | Lamphere | |
| 4,034,514 | A * | 7/1977 | Cecil | E05D 5/04 49/504 |
| 4,195,870 | A | 4/1980 | Percoco | |
| 4,223,494 | A * | 9/1980 | Wendt | E06B 1/32 49/504 |
| 4,281,480 | A * | 8/1981 | Wendt | E06B 1/34 49/504 |
| 4,383,709 | A * | 5/1983 | Ronan | E05B 17/2003 292/340 |
| 4,690,445 | A | 9/1987 | Hartley | |
| 4,717,185 | A | 1/1988 | Hartley | |
| 5,127,690 | A * | 7/1992 | Kim | E05B 15/0245 292/340 |
| 5,456,507 | A | 10/1995 | Jones | |
| 6,282,851 | B1 * | 9/2001 | Beaton | E06B 1/12 49/505 |
| 6,834,897 | B1 | 12/2004 | Walker | |
| 8,407,942 | B1 | 4/2013 | Jones | |
| 8,904,713 | B1 * | 12/2014 | Anderson | E05B 17/2084 292/340 |
| 9,115,501 | B2 * | 8/2015 | Rucinski | E06B 1/6023 |
| 2007/0029823 | A1 | 2/2007 | Gatrell | |
| 2012/0181801 | A1 * | 7/2012 | Willis | E05B 15/0205 292/338 |
| 2013/0074414 | A1 * | 3/2013 | Jones | E05B 17/2084 49/462 |

(Continued)

*Primary Examiner* — Joshua E Rodden
(74) *Attorney, Agent, or Firm* — Ernesto Garcia

(57) ABSTRACT

A door plate provides better safety and security. The plate cannot be kicked in or provide access to a door to be picked. The door plate, in conjunction with a doorjamb, makes one strong unit. The door plate wraps the vulnerable area of the doorjamb with its steel property thus becomes more impervious to splitting the edge of the doorjamb or any part of the protected area of the wrapping. A unique connection in the door plate provides further structural strength and avoids safety hazards when opening and entering a door.

13 Claims, 4 Drawing Sheets

(56) References Cited

U.S. PATENT DOCUMENTS

2014/0346787 A1* 11/2014 Martin, Jr. ..... E05B 17/2003
292/289

* cited by examiner

SAFE AND SECURE DOOR PLATE

TECHNICAL FIELD

The door plate pertains to safely securing doors in particular in strengthening a door's jamb.

BACKGROUND OF THE INVENTION

A home is broken into every 14.5 seconds. Either the door is kicked in or the door latch is pried open with the use of a credit card. Many of the composite doors are strengthened with metal but this is not enough to prevent one from kicking in the door. What is needed is an unparalleled door protection again kicking in doors or compromising the door bolts by strengthening the door's jamb.

Currently, a doorjamb does not prevent the door from being kicked in with brunt force. A brunt force will split the jamb out on the inside edge or have the door jamb split enough for the door to open.

SUMMARY OF THE INVENTION

The present invention prevents exterior wooden doorjambs from being kicked in through the use of a door plate. The door plate enhances the effectiveness of dead bolts, prevents punching door bolts in, and deters thieves from credit carding the dead bolts.

The present invention strengthens the doorjamb with a steel door plate making the doorjamb, in conjunction with the plate, "practically one unit" by wrapping the vulnerable area of the jamb with the steel. The doorjamb becomes more impervious to splitting at the edge or any part of the "protected" area.

The present invention includes a steel plate that wraps the doorjamb under the exterior brick molding and wraps the inside edge under the interior trim casing and extends above and below the door unit.

The invention profiles the doorjamb and wraps the doorjamb from exterior to interior while strengthening the jamb and any lock assembly. It eliminates the weakness in existing current doorjambs that are made of wood, which can easily split wholly or partially.

Some of the benefits include:

1. Flanges inside and out to make the doorjamb secure;
2. Profiles to match the doorjamb;
3. Provides reinforcement to stop deflection;
4. Opens latch areas to allow change service or additions without removal of the secure and safe plate; and,
5. Reverses to be installed in a left side or a right side hinging door.
6. Avoids safety hazards to adult hands or kid's head.

This makes the doorjamb stronger in the applied area. The latch area strongly resists splitting from exterior efforts. The plate enhances strength while making it aesthetically pleasing. A gusset or hem stops the secure plate from bending or flexing at a critical point. The invention allows for changing regular latch plates or adding another lock assembly at any time after the plate is installed.

The plate includes "wrapping flanges" that hold the jamb secure and distribute any force applied to the door over a large area on the face edge of the jamb to disperse and weaken the force of a blow. A center reinforcement web resists flexing but in turn absorbs and negates some of the force. The wrapping flanges also stop the inside of the doorjamb from splitting away. The reinforcement web area also protects the latch bolts from easy access for breaching.

The reinforcement web makes it extremely difficult to pry the door bolt back from its latch plate to open the door without turning a doorknob. The result is a far more secure door assembly.

The instant invention would be made from steel and could be pressed out from flat stock or bent in presses. The door plate areas could be punched out in another press. The screw holes would then be drilled or the entire unit could be cast in a mold and the prefinished unit plated with bright brass, antique brass, or nickel for the end finish.

The instant invention is envisioned to have added a plate for a deadbolt and could be made as part of the plate. This plate would work for left or right hinging doors with no alteration and if a deadbolt plate were part of this then you would have to have a reversed unit to fit opposite swing doors.

While this unit is configured for a four inch wall or door jamb it would need to stretched two inches in width to accommodate a six inch door jamb.

It is envisioned that the reinforcement web is a bent hem or a lip welded to a second lip representing a gusset.

It is envisioned to make one of the embodiments of the door plate from two pieces and securely joined to each other using a unique welded interlocking connection in the form of a hem, which has a many functions. This welded interlocking connection provides:

- a non-bendable plate for security;
- a quadruple thickness and forms a hem parallel to webs;
- the hem provides inaccessibility to any door bolt; and,
- the hem has smooth edges and has no perpendicular protrusions resulting in no safety hazards to adult hands or knuckles. In addition is much safer for children as there are no perpendicular protrusions for children to bump their head, face, or forehead into.

DETAILED DESCRIPTION

Figure 1:
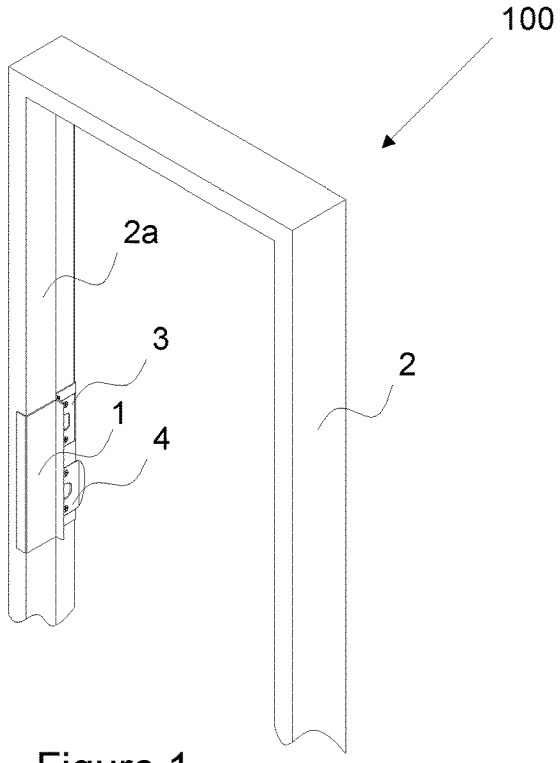
FIG. 1 shows an isometric left side view of a doorjamb in conjunction with the safety door plate.
Figure 2:
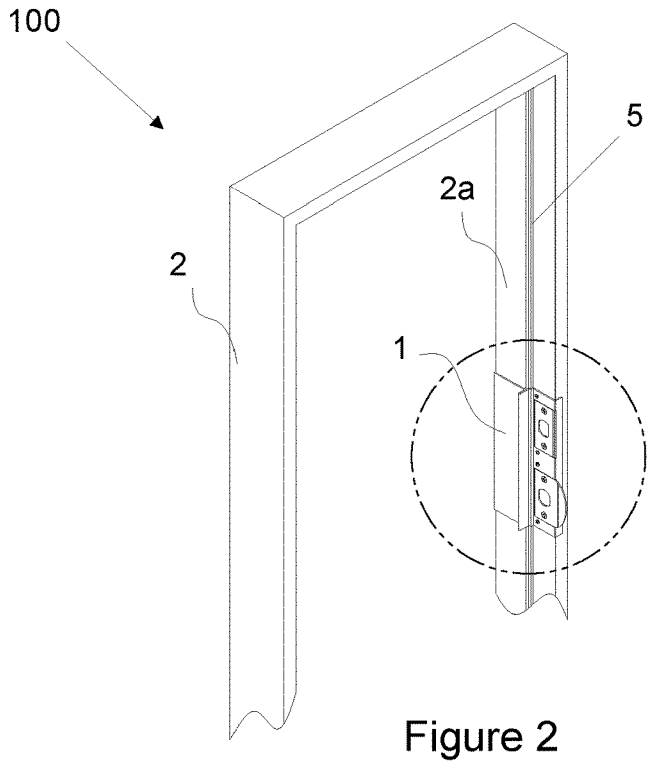
FIG. 2 shows an isometric right side view of the doorjamb in conjunction with the safety door plate.
Figure 3:
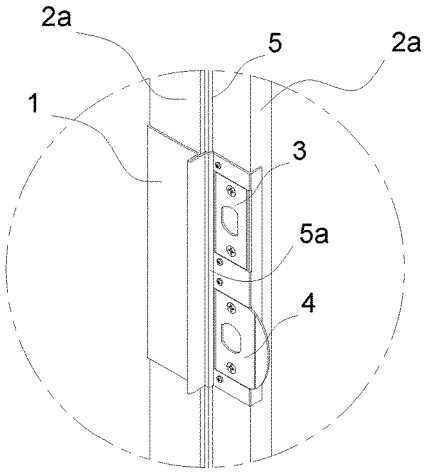
FIG. 3 shows a blown-up view of section 3-3 shown in FIG. 2.

FIG. 1 shows a jamb and safety plate assembly 100. The assembly comprises an ordinary doorjamb 2 including a step 2*a*. FIG. 1 shows the assembly 100 without any exterior brick molding or the interior trim casing. FIGS. 1 and 2 show a safety plate 1 fixed to the doorjamb 2 and two strike plates 3, 4 of a lock unit and deadbolt unit not shown. Adjacent to the step 2*a*, a weather strip 5 runs along the boarder of the doorjamb and a portion of a weather strip 5*a* is affixed to over the safety plate 1 as shown in FIGS. 2 and 3.

Figure 4:
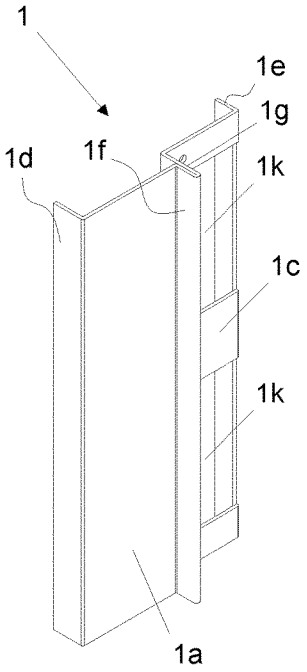
FIG. 4 shows an isometric view of the safety door plate.
Figure 5:
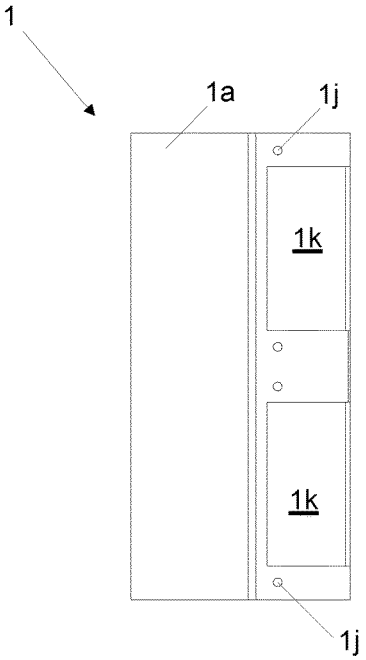
FIG. 5 shows a front view of the safety door plate shown in FIG. 4.
Figure 6:
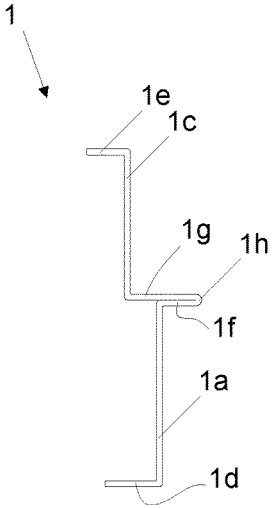
FIG. 6 shows a top view of the safety door plate shown in FIG. 4.

FIGS. 4-6 show the details of the safety plate 1. The safety plate 1 is comprised of a first web 1*a* and a second web 1*c* with a reinforcement hem 1*h* shown in FIG. 6. The first web 1*a* and the second web 1*c* are offset and parallel to each other. The reinforcement hem 1*h* is comprised of a first lip 1*f* extending perpendicular to the first flange 1*a* and bending to a second lip 1*g* that perpendicularly intersects the second web 1*c*. As shown in FIG. 5, the second web 1*c* includes at least one opening 1*k*. In the example of FIG. 5, the second web 1*c* includes two openings 1*k* where two strike plates 3, 4 fit and can be fixed to the doorjamb 2. The second web 1*c* includes at least one fastening hole 1*j*. Although, it is envisioned that at least one fastening hole 1*j* be on the second web 1*c*, more than one fastening hole can be located anywhere in the safety plate 1 to fasten the safety plate 1 to the doorjamb 2.

As shown in FIGS. 4 and 6, the first web 1*a* and the second web 1*c* respectively includes at least one wrapping flange comprising a first wrapping flange 1*d* and a second wrapping flange 1*e*. The first wrapping flange 1*d* extends opposite to the first lip 1*f* and the second wrapping flange 1*e* extends opposite to the second lip 1*g*. Both wrapping flanges 1*d*, 1 *e* extend parallel and in the same direction to each other.

Figure 7:
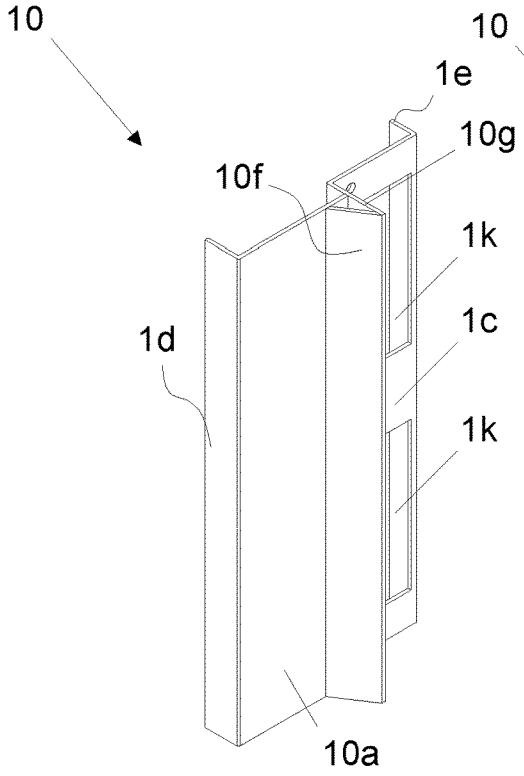
FIG. 7 shows an isometric view of a second embodiment of a safety door plate.
Figure 8:
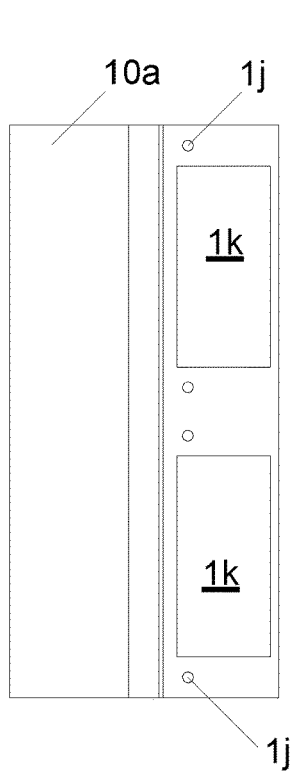
FIG. 8 shows a front view of the safety door plate shown in FIG. 7.
Figure 9:
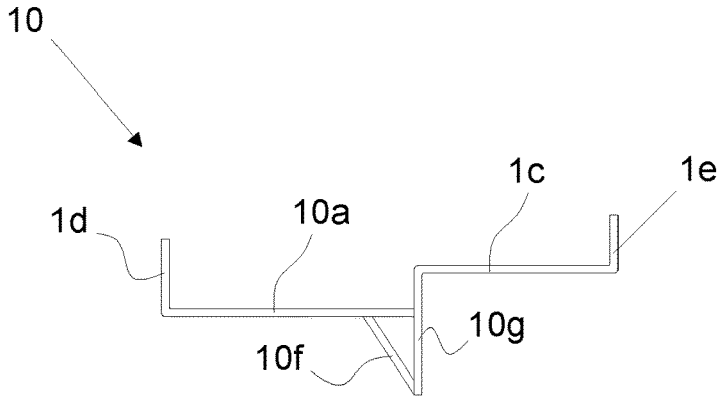
FIG. 9 shows a top view of the safety door plate shown in FIG. 7.
Figure 10:
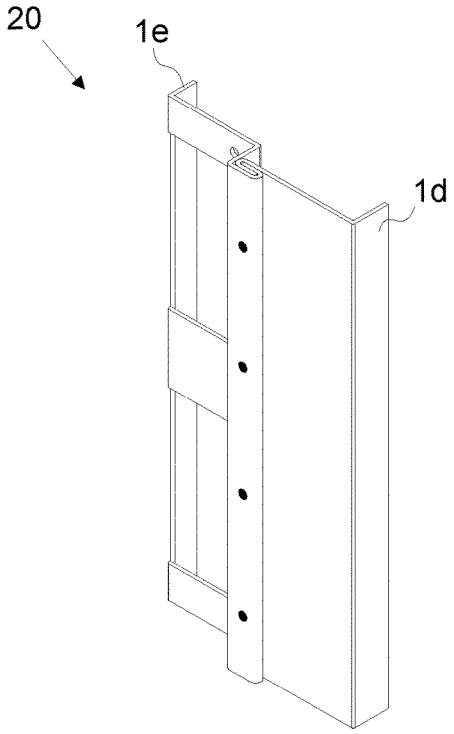
FIG. 10 shows isometric view of a third embodiment of the safety door plate.
Figure 11:
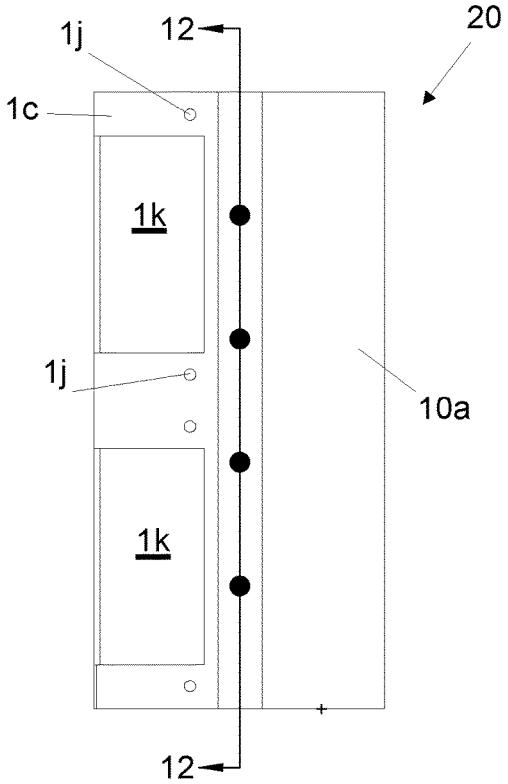
FIG. 11 shows a front view of the safety door plate shown in FIG. 10.
Figure 12:
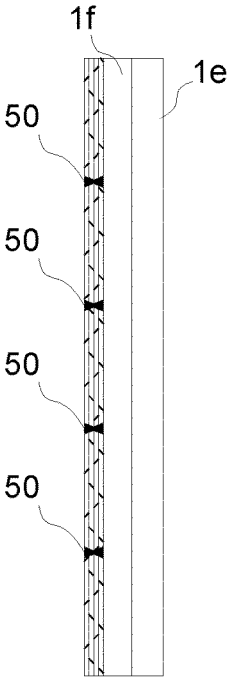
FIG. 12 shows cross-sectional view 12-12 in the door plate shown in FIG. 11.

FIGS. 7-9 show a second embodiment of the safety plate 10. Some features are the same as the first embodiment of the safety plate 1 shown in FIGS. 4-6. The safety plate 10 includes a first web 10*a* and a second web 1*c*. The first web 10*a* and the second web 1*c* are offset and parallel to each other. A reinforcement web comprised of a first lip 10*f* extending at an angle to the first flange 10*a* and connecting to a second lip 10*g* that perpendicularly intersects the second web 1*c*. As shown in FIG. 8, the second web 1*c* includes at least one opening 1*k*. In the example of FIG. 8, the second web 1*c* includes two openings 1*k* where two strike plates 3, 4 can fit and be fixed to the doorjamb 2. The second web 1*c* includes at least one fastening hole 1*j*. The first lip 10*f* is welded to the first web and the second lip 10*g*.

As shown in FIGS. 7 and 9, the first web 10*a* and the second web 1*c* respectively includes at least one wrapping flange comprising a first wrapping flange 1*d* and a second wrapping flange 1*e*. The first wrapping flange 1*d* and the second wrapping flange 1*e* extend opposite to the second lip 10*g*. Both wrapping flanges 1*d*, 1*e* extend parallel and in the same direction to each other.

Figure 13:
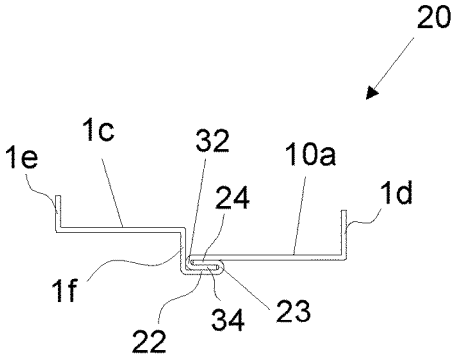
FIG. 13 shows a top view of the safety door plate shown in FIG. 10.

FIGS. 10-13 shows a third embodiment of the safety door plate 20. This door plate is 20 is composed two pieces joined together forming a hem there between. Similar features as those door plates 1, 10 before are present in this door plate 20. The first web 10*a* and the second web 1*c* respectively includes at least one wrapping flange comprising a first wrapping flange 1*d* and a second wrapping flange 1*e*. The first wrapping flange 1*d* and the second wrapping flange 1*e* extend parallel and in the same direction to each other. As seen in FIG. 13, the second web 1*c* includes a first lip 1*f* extending perpendicular from second web 1*c* and extending in an opposite direction to the second wrapping flange 1*e*. A second lip 22 extends perpendicular from the first lip 1*f* and oriented in an opposite direction to the second web 1*c*. The second lip 22 includes a folded wall 24 via a bent 23. The folded wall 24 extends 180 degrees to the second lip and parallel to the second lip 22 forming a gap there between. The first web 10*a* also includes a folded wall 34 that is folded 180 degrees via a bent 32 resulting a gap between the folded wall 34 and the first web 10*a*. The folded wall 24 is therefore received between the folded wall 34 and the first web 10*a* while the folded wall 34 is received between the folded wall 24 and the second lip 22 creating a locking hem of four walls parallel to each other.

It is envisioned that the second lip 22, the first web 10*a*, and the folded walls 24, 34 are compressed to each other in a similar fashion sheet metal is processed by bending and pressing to form metal hems. To further strengthen the connection between the two pieces of the door plate 20, the second lip 22, the first web 10*a*, and the folded walls 24, 34 are spot welded at different locations 50 from opposite sides. This prevents a thief from prying out the folded walls 24, 34 and further strengthens the connection there between.

The following is a set of instructions to install the plate: Install the plate on the doorjamb leaving spaces open where an existing latch plates are located. Briefly hold the safety plate in place over the doorjamb and mark the top, bottom and center of the unit on the doorjamb. Cut the weather stripping that would be covered by the new plate. Remove the weather stripping that was cut and set aside. Gently pry the exterior and interior trim away from the doorjamb. Now slide the new plate into position and attach with four screws. Glue the weather strip back in place or use the self-sticking strip that came with the new plate. Adjust the moldings as needed.

It should be understood that the strengthening hem 1*h* or the interlocking connection found in the safest door plate 20 strengthens the safety plate overall and prevents thieves from credit carding any door lock. Similar in concept, the first lip 10*f* and the second lip 10*g* together strengthen the safety plate and deter thieves from credit carding any door lock. Although it is envisioned to make the safety plate 1, 10, 20 from steel, the safety plate could as well be made from any known weldable material. While the fastening hole 1*j* is circular, they can be countersunk or counterbore to accommodate a respective fastener.

The invention claimed is:

1. A door plate comprising a first web, a second web, and an interlocking connection between the first web and the second web;

wherein a first lip extends perpendicular to the second web and a second lip extends perpendicular to the first lip;

wherein the interlocking connection comprising the first web including one folded wall parallel to the first web and forming a gap between the folded wall and the first web;

wherein the interlocking connection further comprising the second lip including one folded wall parallel to the second lip and forming a gap between the folded wall of the second lip and the second lip;

wherein the folded wall of the first web being received in the gap formed between second lip and the folded wall of the second lip; and, wherein the folded wall of the second lip being received in the gap formed between first web and the folded wall of the first web.

2. The door plate of claim 1, wherein the first web and the second web extend in opposite directions.

3. The door plate of claim 2, wherein the second web comprises at least one opening for accepting a strike plate.

4. The door plate of claim 2, wherein the second web includes at least one fastening hole.

5. The door plate of claim 1, wherein the first web and the second web each include a wrapping flange parallel to each other; and, wherein the wrapping flange of the first web and the wrapping flange of the second web project in the same direction; and, wherein the wrapping flange of the first web projects perpendicular to the first web, and the wrapping flange of the second web projects perpendicular to the second web.

6. The door plate of claim 1, wherein the second web includes at least one fastening hole.

7. The door plate of claim 1, wherein the second lip, the first web, and the folded walls are parallel to each other.

8. The door plate of claim 7, wherein the second lip, the first web, and the folded walls are spot welded there between to further strengthen the interlocking connection.

9. The door plate of claim 8, wherein the first web and the second web extend in opposite directions.

10. The door plate of claim 9, wherein the second web comprises at least one opening for accepting a strike plate.

11. The door plate of claim 9, wherein the second web includes at least one fastening hole.

12. The door plate of claim 8, wherein the first web and the second web each include a wrapping flange parallel to each other; and, wherein the wrapping flange of the first web and the wrapping flange of the second web project in the same direction; and, wherein the wrapping flange of the first web projects perpendicular to the first web, and the wrapping flange of the second web projects perpendicular to the second web.

13. The door plate of claim 8, wherein the second web includes at least one fastening hole.

* * * * *